United States Patent [19]

Kobelt

[11] Patent Number: 4,512,451

[45] Date of Patent: Apr. 23, 1985

[54] SINGLE LEVER CONTROL ASSEMBLY TO PERMIT DISENGAGEMENT BETWEEN TWO FUNCTIONS

[76] Inventor: Jacob Kobelt, 6110 Oak St., Vancouver, British Columbia, Canada, V6M 2W2

[21] Appl. No.: 390,243

[22] Filed: Jun. 21, 1982

[51] Int. Cl.[3] ..... B60K 41/02; G05G 9/08

[52] U.S. Cl. ..... 192/0.096; 74/473 R; 74/491; 74/507; 74/509

[58] Field of Search ..... 192/0.096, 0.098; 74/471 R, 471 XY, 483 R, 491, 502, 507, 569, 876, 480 B, 480 R, 473 R, 509

[56] References Cited

U.S. PATENT DOCUMENTS

| | | | |
|---|---|---|---|
| 3,146,632 | 9/1964 | Irgens | 74/876 X |
| 3,204,732 | 9/1965 | Morse | 74/876 |
| 3,741,044 | 6/1973 | Baba | 74/876 |
| 3,741,045 | 6/1973 | Kobayashi | 74/876 X |
| 4,106,604 | 8/1978 | Baba | 192/0.098 |
| 4,144,956 | 3/1979 | Baba | 74/876 X |
| 4,205,738 | 6/1980 | Baba | 74/876 |

*Primary Examiner*—George H. Krizmanich

*Attorney, Agent, or Firm*—Carver & Co.

[57] ABSTRACT

A control lever assembly, particularly for controlling marine propulsion systems, having first and second signal outputs controllable simultaneously by a single lever. The lever is journalled for rotation about a lever axis relative to a body, and can be shifted axially between engaged and disengaged positions. An interrupter driver has driving engagement structure and responds to lever rotation and cooperates with the first signal output. An interrupter driven structure has driven engagement structure which is engageable with the driving engagement structure when the lever is in the engaged position, and is disengageable when the lever is in neutral and is shifted axially. When engaged, the second signal output is responsive to primary rotation of lever. Selector structure permits the axial movement only when the lever is in neutral, and simultaneously permits rotation of the lever to control the first signal output with no corresponding change in the second signal output. The assembly also permits easy conversion to a twin engine control in which equal rotation of the levers produces essentially identical output signals.

25 Claims, 7 Drawing Figures

12,14
10
24
17
21
36
26
31
16
22
100
163
164
15
37
70
160
173,167
168
169
170
101
159
158
66,68
103
171
109
64
78
108
40
33
35
22
24
37
31
15
70
66, 68
28
64
78
84
12, 14
83
81
97
90
96
88
25
91
84
152
12,14
22
17
37
36
35
26
16
155
24
163
68
100
164
64
70
101
170
168
160
157
110
167,173
48
171
156
109
159
172
158
108
84
83

SINGLE LEVER CONTROL ASSEMBLY TO PERMIT DISENGAGEMENT BETWEEN TWO FUNCTIONS

BACKGROUND OF THE INVENTION

1. Field of the Invention

The invention relates to a control lever assembly in which a single lever is adapted to control two functions, and is particularly adapted for, but not limited to, controlling a marine propulsion system for controlling a throttle and a clutch/gearbox assembly.

2. Prior Art

Single lever control assemblies for marine control applications as above have been used for many years and commonly are relatively complex apparatus which are costly to manufacture and service. In many prior art apparatus there is an unsatisfactory proportionality between movement of the lever and a corresponding movement of a signal output means which is responsive to the lever. Commonly, particularly with marine control appartus, one function requires operating independently of the other, for example, when the clutch/gearbox assembly is in neutral and the throttle is to be operated to drive auxiliary apparatus independently of the gearbox, called a throttle override. In such apparatus, disengagement of the clutch signal output means to enable independent operation of the throttle signal output means commonly necessitates disengageable couplings between the lever and the signal output means. This further increases complexity and cost of the apparatus.

An apparatus of this general type is shown in U.S. Pat. No. 4,106,604 in which the inventor is Masanao Baba. Whilst this apparatus has a desirable lever/output proportionality which is an improvement over some previous devices, it can be seen that this is a relatively complex apparatus which would likely incur relatively high manufacturing and maintenance costs.

SUMMARY OF THE INVENTION

The invention reduces difficulties and disadvantages of the prior art by providing a control lever assembly for a single lever control in which two signal output means can be operated concurrently by rotation of the single lever, or, after disengagement of one of the signal output means by a simple movement of the lever, the remaining signal output means can be operated independently of the disengaged signal output means. The invention is characterized by a simple rugged structure which is relatively inexpensive to manufacture and maintain, and furthermore, when used in a marine power plant, provides a desired proportionality of a throttle signal output relative to rotation of the lever.

A control lever assembly according to the invention has a body and a lever mounted for primary and secondary rotation about a lever axis relative to the body. The lever is also mounted for axial movement along the lever axis relative to the body between engaged and disengaged positions. First and second signal output means are mounted for rotation relative to the body and the assembly is further characterized by interrupter driving means, interrupter driven means and selector means. The interrupter driving means cooperates with the first signal output means and with the lever and is responsive to the rotation of the lever. The interrupter driven means cooperates with the second signal output means and is engageable with the interruptor driving means when the lever is in the engaged position so that the driven means is responsive to at least a portion of the lever rotation. The selector means permit axial movement of the lever between the engaged and disengaged positions when the lever is in a particular position only, the selector means having a projection and a wall member. The projection is mounted for rotational movement with the interrupter driven means and the wall member is mounted for axial and rotational movement with the lever. The wall member has a clearance opening of a size adapted to pass the projection when aligned therewith during the axial movement of the lever in the particular position, and to interfer with the projection when non-aligned. Thus, the axial movement permits disengagement between the driven means and the driving means and when so disengaged to permit rotation of the lever and the interrupter driving means with no corresponding movement of the second signal output means.

In one embodiment, in which the selector means is not necessarily limited to the wall member and projection as specified above, the lever is mounted for primary and secondary rotation and the interrupter driving means is responsive to the primary and secondary rotation and also has a driving engagement means and a non-driving surface means adjacent the driving engagement means. The interrupter driven means has a driven engagement means which is responsive to the primary rotation of the lever when engaged and has a non-driven surface means adjacent the driven engagement means so that when the lever is in the engaged position, during secondary rotation of the lever, the non-driving and non-driven surface means interfere with each other so that the interrupter driven means and the second signal output means are non-responsive to the secondary rotation of the interrupter driving means.

Furthermore, in another embodiment, in which the selector means is also not necessarily limited to the wall member and projection as specified above, the assembly includes a rotation limiter means characterized as follows. The interrupter driving means has a partially cylindrical surface responsive to lever rotation. Also, the interrupter driven means has a cooperating surface which interfers with the partially cylindrical surface to prevent rotation of the interrupter driven means.

A detailed disclosure following, related to drawings, describes a preferred embodiment of the invention which is capable of expression in structure other than that particularly described and illustrated.

DETAILED DISCLOSURE

Figure 1:
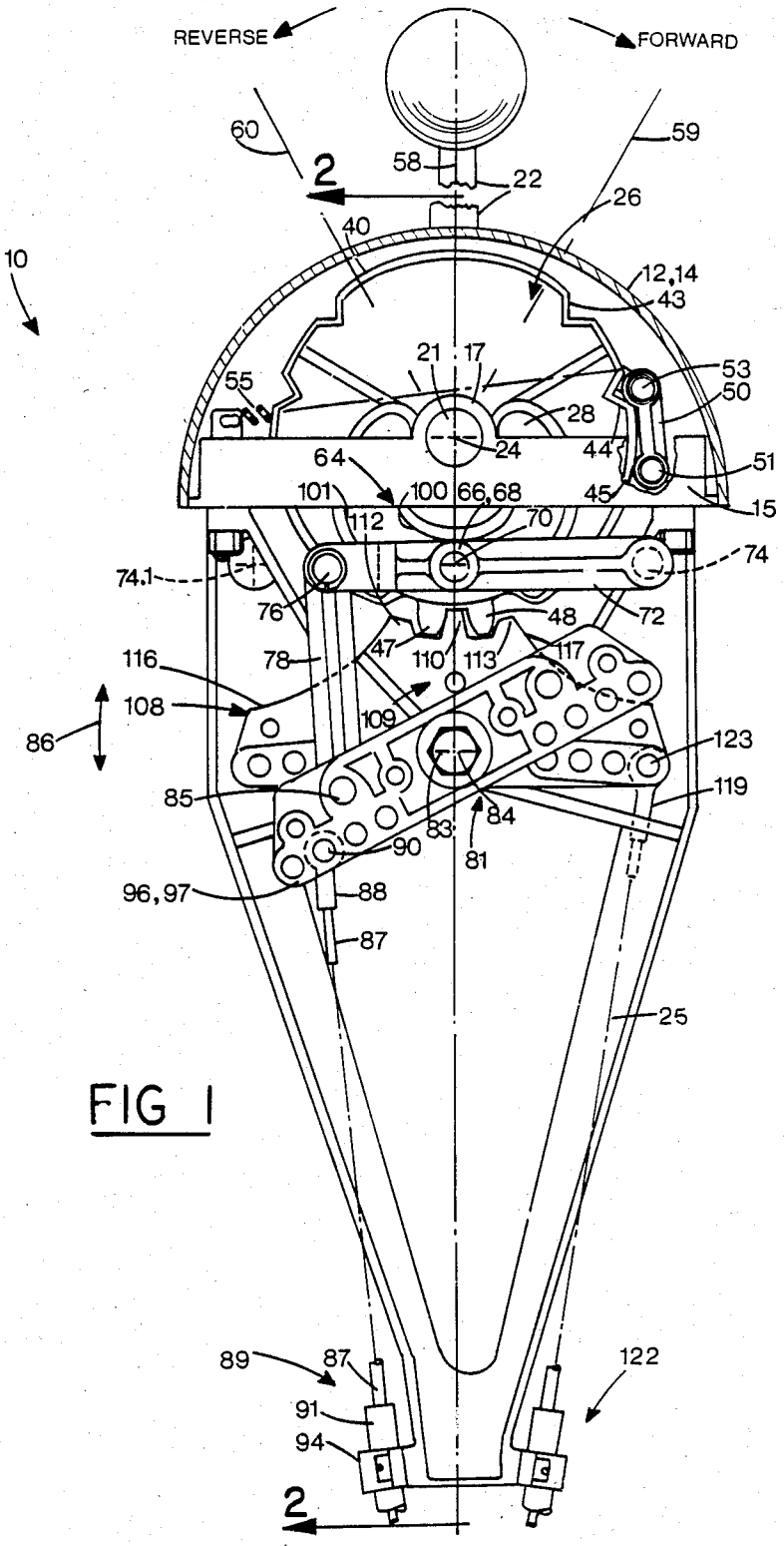
FIG. 1 is a simplified fragmented side elevation of a control lever assembly according to the invention shown in an engaged and neutral position, some portions being omitted for clarity.
Figures 2, 3, 5:
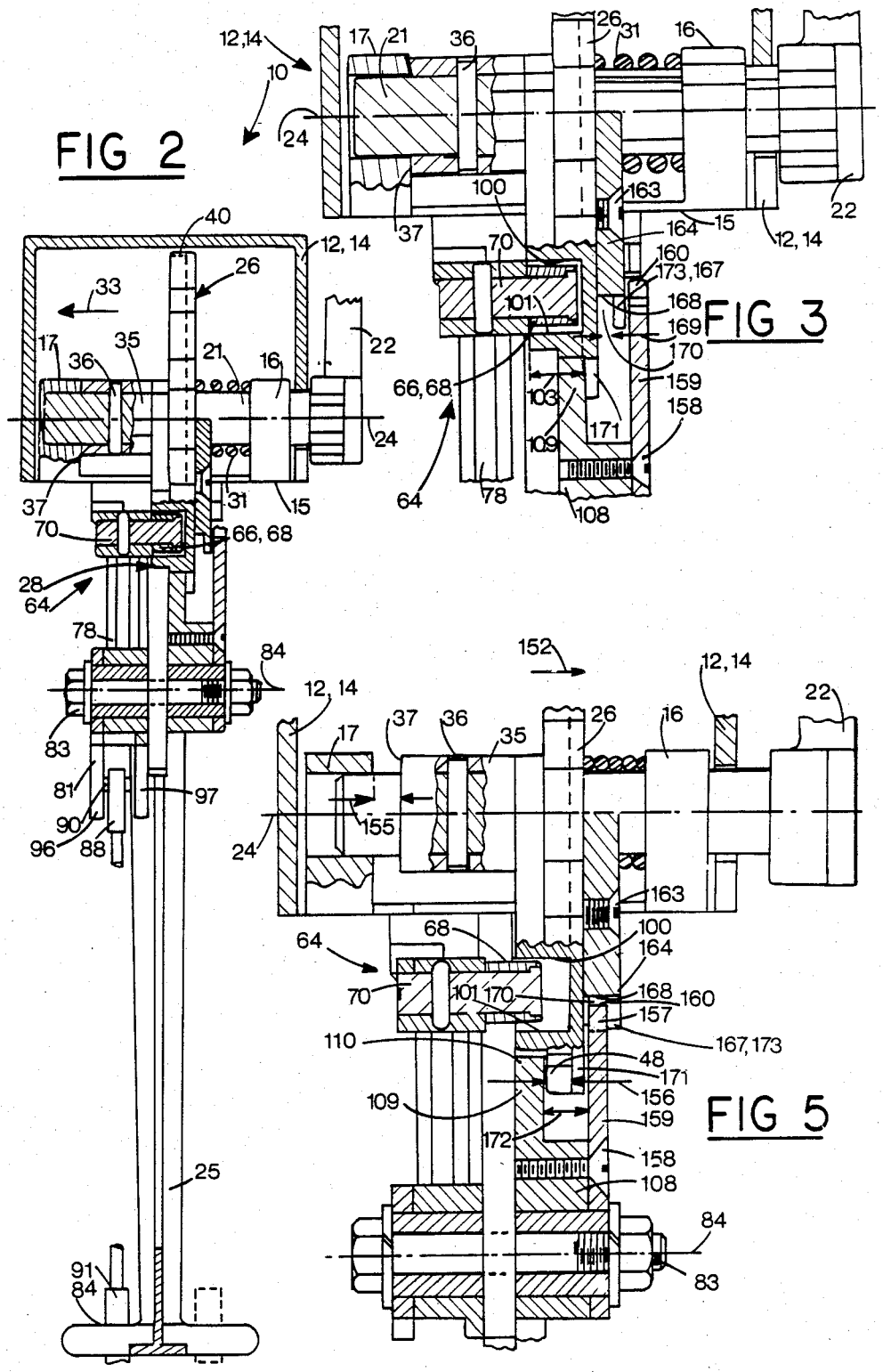
FIG. 2 is a simplified fragmented section on line 2—2 of FIG. 1, some portions being omitted and some portions not being sectioned for clarity.
FIG. 3 is an enlarged fragmented detailed section of portions of FIG. 2 showing cooperation between selector means and cam means when the lever is in the engaged and neutral position.
FIG. 5 is a simplified fragmented detail section at enlarged scale, showing the components shown in FIG. 3, but with the lever in a disengaged position which is used to select a throttle override mode of operation.

FIGS. 1 through 3

A control lever assembly 10 according to the invention has a body 12 having a generally cylindrical shell 14 mounted on a base 15. The base carries a pair of spaced journals 16 and 17 and a lever shaft 21 is mounted in the journals and carries a lever 22 at an outer end thereof. Thus, the lever is mounted for rotation about a lever axis 24 relative to the body. The base also carries a downwardly extending frame 25 which holds push/pull control cables as will be described.

The shaft 21 carries a cam plate 26 secured thereto, the cam plate having a cam track 28 on a side thereof remote from the lever. A compression coil spring 31 encircles the shaft 21 and is disposed between the plate 26 and the journal 16 so as to force the cam plate, and with it the shaft 21, in direction of an arrow 33. The cam plate 26 has an annular boss 35 secured to the shaft 21 with a pin 36, the boss having an end shoulder 37 which contacts the journal 17 to limit movement of the shaft 21 relative to the journals. Movement of the shaft 21 in the opposite direction is limited by a selector means as will be described. Thus the shaft, and with it the lever, is mounted for axial movement along the lever axis relative to the body between two positions, which are termed engaged and disengaged positions as will be described with reference to FIGS. 3 and 5.

The cam plate 26 has a generally circular periphery 40 concentric with the axis 24, which periphery, in one portion thereof, contains a plurality of three peripherally spaced recesses 43 through 45 which serve as index locations, and a pair of spaced gear teeth 47 and 48 on a lower portion of the periphery as shown. A hinged indexing arm 50 is hinged to the body at a hinge 51 at an inner end and carries a roller 53 at an outer end, which roller is adapted to engage the periphery 40 or the particular recesses 43 through 45, depending on the position of the cam plate. A tension coil spring 55 extends between the outer end of the arm 50 and an opposite portion of the body to draw the roller 53 onto the periphery 40. Thus it can be seen that the hinged arm 50 and roller 53 serve as indexing means mounted on the body for motion relative thereto to cooperate with the cam plate, and the cam plate has index locations thereon complementary to the index means to reflect particular locations of the lever when engaged by the indexing means. As will be described, when the recess 44 is engaged by the roller 53 as shown, the lever is in a neutral position 58, shown as a mid position, and when the recesses 43 or 45 are engaged, the lever is in forward or reverse positions respectively as shown in broken outline as lines 59 and 60. Three similar but unused and undesignated recesses are provided on an opposite portion of the periphery 40 for use if an opposite handed characteristic is required.

The assembly 10 has a cam means 64 which comprises the cam track 28 and a cam follower 66, which follower includes a roller 68 mounted for rotation on a roller spindle 70 extending from a cam arm 72. The cam arm 72 has an inner end hinged on a cam hinge 74 and an outer end carrying a connector pin 76 which journals a connecting link 78 to the cam arm. A throttle signal output member 81 is a rocker arm hinged on a output hinge pin 83, in this case a nut and bolt assembly, a center of the pin defining a signal output axis 84. The output member 81 carries a connecting pin 85 which connects the connecting link 78 to the output member. Thus the link 78 extends between the cam arm and the throttle signal output member 81 to transfer cam arm rotation to the throttle signal output member per arrow 86. A cable core 87 has a cable core fitting 88 connected by a pin 90 to the throttle output member 81 and runs in a cable sheath 91 of a push/pull control cable assembly 89 running to a throttle actuator, not shown. The sheath is retained at a lower end of the frame 25 by a cable clamp 94 and it can be seen that rotation of the member 81 slides the core within the sheath to actuate the throttle actuator. The throttle output member 81 has a pair of spaced parallel flanges 96 and 97 provided with aligned, undesignated recesses or openings, and the pin 90 is fitted in the required pair of openings to provide the desired throw on the cable in proportion to rotation of the member 81. The cam track 28 is defined in part by spaced cam side walls 100 and 101 which are spaced apart to receive the roller 68 therebetween. The side walls have a width which defines depth 103 of the cam track which is greater than axial movement of the driving means between engaged and disengaged positions, that is the axial shifting of the shaft 21 as will be described with reference to FIG. 5.

A clutch signal output member 108 has a toothed portion 109 which has a central gear tooth 110 straddled by a pair of shortened outer gear teeth 112 and 113 to define recesses therebetween to accept the gear teeth 47 and 48 of the cam plate 26 when the lever 22 is in the engaged neutral position. It can be seen that, when the teeth of the cam plate 26 are in engagement with the teeth of the toothed portion 109 of the member 108, rotation of the cam plate produces a proportional but opposite rotation of the output member 108. The clutch signal output member 108 is hinged for rotation on the pin 83 and has a pair of concave surfaces 116 and 117 spaced outwardly from the outer teeth 112 and 113 as shown in FIG. 1, but is shown more clearly in FIG. 4. The surfaces 116 and 117 are generally complementary to the partially cylindrical periphery 40 of the cam plate so that, in particular relative positions of the cam plate and toothed portion 109 following limited rotation of the cam plate 26, not shown, the teeth becomes disengaged and one of the surfaces 116 or 117 is positioned closely adjacent a portion of the periphery 40. Because the gear teeth are disengaged, the clutch signal output member 108 becomes unresponsive to rotation of the cam plate over a particular portion of arc. This mechanism is well known and is equivalent to a Geneva stop which is one example of an intermittent or interrupter drive means in which the teeth 47 and 48 and adjacent concentric arc portions of the periphery 40 are a portion of an interrupter driving means, and the teeth of the portion 109 and the complementary surfaces 116 and 117 are a portion of an interrupter driven means. It can be seen that when the teeth are disengaged in the manner above, the cam plate can be rotated without causing a corresponding rotation of the member 108.

A cable core fitting 119 is at one end of a core of a clutch operating push/pull control cable 122 and is similarly journalled on a pin 123 between spaced parallel flanges, not shown, of the clutch signal output member 108. The structure for connecting the control cable 122 to the apparatus is similar to that for the cable 89. When the gear teeth as above described are engaged in the neutral position, rotation of the lever produces a corresponding shift of the core of the cable 122 with a corresponding signal to the clutch actuating means, not shown. This method of clutch actuation is known and when engaged as described, functions equivalently to known devices. One feature of the present invention is particularly directed to a means of disengaging the teeth 47 and 48 of the cam plate from those of the toothed portion 109 when the lever is in neutral, so as to permit essentially unlimited independent rotation of the cam plate with zero rotation of the clutch output member 108 from the neutral position. This will be described in greater detail with reference to FIGS. 5 and 7.

FIG. 4

The cam track has a primary portion 131 which extends over an arc of approximately 60° disposed equally about an axis representing the neutral position 58 of the lever, when the cam is in neutral as in FIG. 1. The primary portion is a circular arc concentric about the lever axis 24 and represents approximately movement of the lever 22 from the neutral position through arcs 133 or 134 to attain the forward or reverse positions 59 or 60 for engaging forward or reverse gears, forward position being shown in FIG. 4. It is noted that when the roller 68 is cooperating with the primary portion of the cam track it is essentially uneffected by cam rotation through the primary angle, termed primary rotation, and thus the cam arm 72 remains essentially stationary. This primary rotation represents an essentially unchanging throttle signal, usually idle, which is maintained when the lever is shifted from neutral to either forward gear engaged, or reverse gear engaged positions. The cam track also contains secondary portions 137 and 138 which are spaced on opposite sides of the primary portion, the primary portion merging smoothly with the secondary portions at positions 139 and 140. The secondary portions 137 and 138 are curves which each occupy approximately 50° of arc and are eccentric relative to the axis 22 and are curved so as to produce a gradually increasing displacement of the roller 68 from the position it maintains during the primary rotation. That is there is a gradually increasing displacement of the arm 72 as the cam plate is rotated from an engaged position were the roller 68 is at the position 139 or 140 to an extreme position where the roller is at an outer end of the cam track. Thus, total radial displacement of the roller 68 from the start of the secondary rotation to the finish of the secondary rotation provides a corresponding swing of the arm 72, which, through the link 78, is transmitted to the throttle signal output member 81 to produce a corresponding throttle signal ranging from idle to full throttle. Thus the interrupter driving means cooperates with the throttle signal output means and with the lever and is responsive to primary and secondary rotation of the lever. It can be seen that the secondary portions 138 and 137 are equal, representing equal throttle signals for when the gear is engaged in either forward or reverse, but this is not essential, and if desired, the maximum reverse signal can result in less than full throttle in some applications.

Figure 4:
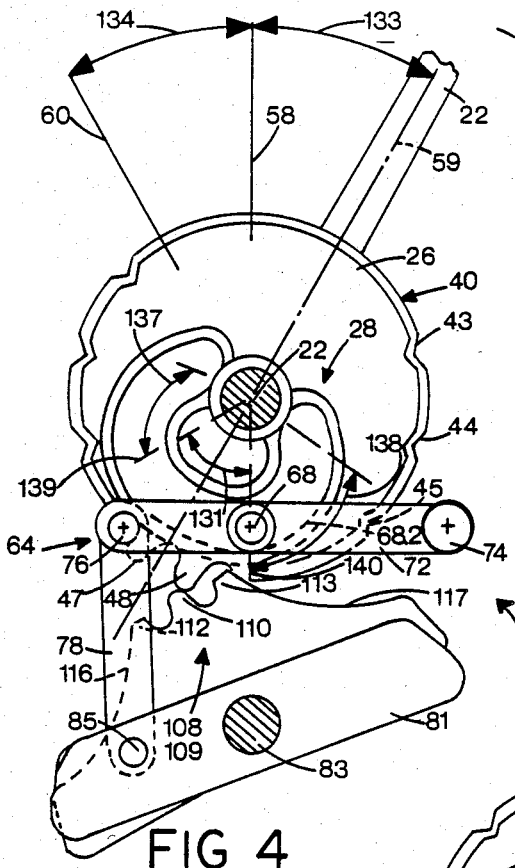
FIG. 4 is a simplified partially fragmented diagram similar to FIG. 1 and showing operative portions of the control lever assembly during movement of the lever from the neutral position towards a gear engaged position, with corresponding movement of the respective signal output means.

As seen in FIG. 4, the lever 22 is being swung in direction of an arrow 143 and is shown in a position of initial forward gear engagement when the toothed portion 109 is disengaging from the tooth 48. The output member 108 is shown swinging in direction of an arrow 144 with the concave surface 117 rapidly approaching the periphery 40 of the cam plate to attain a non-driving engagement position. The roller 68 is shown located in the cam track 28 approximately at the position 140, which position represents termination of the primary rotation and commencement of secondary rotation. In this position, the roller 53, FIG. 1 only, engages the recess 43 and the forward gear is engaged and the thottle output will soon be moved from the idle position. There is sufficient lost motion in the various linkages and hydraulic actuators for the surface 117 to contact the complementary periphery 40 prior to acceleration of the engine from idle. Thus, in summary, it can be seen that the cam track has a primary portion which is a curve which is concentric with the lever axis and represents primary rotation of the lever and the cam track, and a secondary portion which is a curve which is eccentric relative to the lever axis and which represents secondary rotation of the lever. Also, it can be seen that the throttle signal is outputted by a throttle signal output means having the cam follower mounted on the cam arm which cooperates with the cam means, the cam arm also cooperating with the thottle signal output means to reflect cam follower movement.

Figure 6:
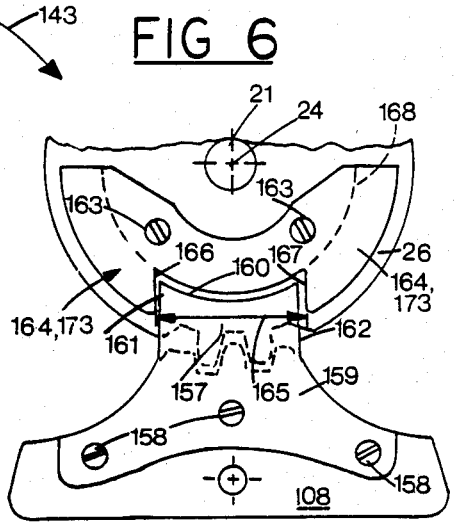
FIG. 6 is a simplified diagram showing cooperation between portions of the selector means which are omitted in FIG. 1.

FIGS. 3, 5 and 6

An important feature of the invention relating to the interrupter drive means will now be described. As previously stated, the shaft 21 is mounted in the journals 16 and 17 for axial movement per an arrow 152 along the lever axis 24 from the position shown in FIG. 3, termed engaged position, in which the shoulder 37 is adjacent the journal 17, to the position shown in FIG. 5, termed disengaged position, in which the shoulder 37 is separated from the journal 17 by a spacing 155. The spacing 155 is somewhat greater than axial width 156 of the teeth 47 and 48 of the cam plate and represents axial movement necessary for complete disengagement of the teeth 47 and 48 from the toothed portion 109 of the clutch signal output member 108.

As best seen in FIG. 6, the member 108 carries a plate-like projection member 159 secured thereto with three screws 158 and having a projection 157 with a concave outer end wall 160 which, as drawn in neutral, is concentric with the axis 24 and extends between two parallel side walls 161 and 162 which define width of the projection. The cam plate 26 carries a wall member 164 secured thereto with two screws 163 and having a clearance opening 165 defined by spaced apart clearance walls 166 and 167 extending downwardly therefrom. Space between the walls 166 and 167 is greater than the width of the projection 157 so that the projection can pass through the clearance opening 165 in the wall member 164 when aligned with the opening during axial movement of the lever from the engaged to disengaged positions. Adjacent the wall member 164 is a partially cylindrical surface 168, shown in broken outline in FIG. 6, which is concentric with the lever axis 24 and complementary to, and spaced closely to, the end wall 160 of the projection 157. As seen in FIG. 3, the surface 168 has an axial width 169 so that a rear wall of an extension portion 173 extending from the wall member 164 is spaced from an opposed face of the cam plate 26 by a similar sized gap 170. As seen in FIG. 5, the gap 170 is sufficient to receive the projection 157 therebetween. Thus, the projection is thinner than the gap 170 to permit relative movement between the projection and the wall member when the lever is rotated whilst in the disengaged position. Excessive movement of the shaft 21 in the direction of the arrow 152 is limited by interference between the projection 157 and the wall member 164, which occurs before interference between the adjacent coils of the spring 31. It can be seen that the sum of thickness of the portion 173 plus thickness of the projection 157 is less than the spacing 155 which represents axial movement of the lever or cam plate between engaged and disengaged positions. The clearance opening 165 and the projection 157 are positioned relative to each other so as to be aligned only when the lever 22 is in the neutral position 58, and thus, it can be seen that teeth 47 and 48 of the cam plate can only be disengaged from the toothed portion 109 when the lever is in the neutral position. Thus, the projection 157 interferes with the wall member when not aligned with the recess 162, thus preventing unintentional disengagement of the interrupter drive means. Also, due to closeness of the concave end wall 160 to the partially cylindrical surface 168, interference between the wall 160 and the surface 168 essentially prevents movement of the clutch signal output member 108 during rotation of the lever through approximately 180°, which is of major importance to prevent accidental gear engagement whilst operating auxiliary equipment.

A strengthening flange 171 extends downwardly adjacent the teeth 47 and 48, and has an inner face adjacent the toothed portion 109 when the lever 22 is in the engaged position. Contact between the flange 171 and the portion 109 occurs essentially simultaneously with contact between the shoulder 37 and the journal 17, and thus assists in limiting axial movement of the shaft 21 in direction of the arrow 33, thus reducing effects of wear between the shoulder 37 and the journal 17. As seen in FIG. 5, the flange 171 and the teeth 47 and 48 have a combined axial thickness less than space 172 between the toothed portion 109 and the protection member 159, so that, in the non-neutral position, axial movement of the shaft 21 in the direction of the arrow 152 is prevented by interference between the projection 157 and the wall member 164.

It can be seen that the wall member 164 and projection 157 serve as a selector means to permit axial movement of the lever between the engaged and disengaged positions when the lever is in the neutral position only, so as to disengage the interrupter driving means from the interrupter driven means. As seen in FIG. 5, when in the disengaged position the cam roller 68 is spaced from the bottom of the cam track 28 by an amount approximately equal to axial shift of the cam plate between the engaged and disengaged positions, whilst still maintaining contact with the cam side walls. The cam follower, that is the roller 68, has a width sufficient to maintain contact with the cam track side walls during the axial movement of the shaft 21 and the driving means.

FIG. 7

Figure 7:
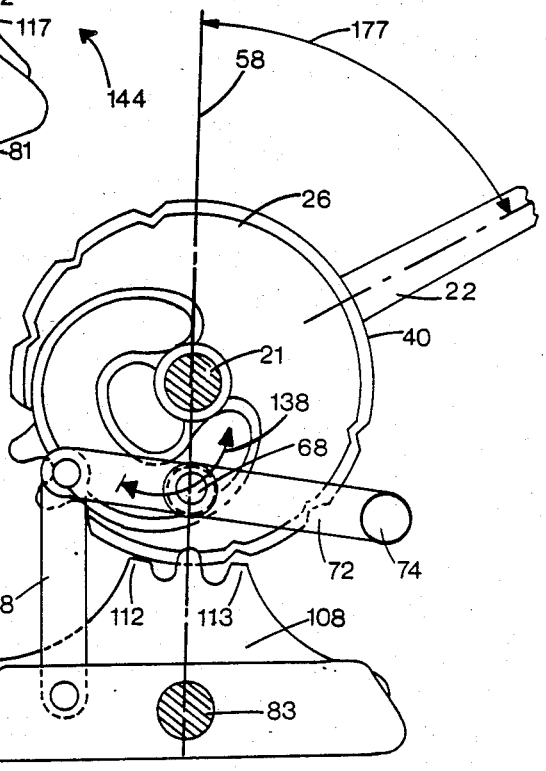
FIG. 7 is a partially fragmented diagram similar to FIG. 4 but showing positions of the operative portions in the throttle override position corresponding to that of FIG. 5.

FIG. 7 represents a position where the lever 22 has been swung through an angle 177 from the neutral position 58 after the interrupter drive means has been disengaged. The roller 68 is in the secondary portion 138 of the cam track 28, at a position which represents approximately mid throttle position. The cam arm 72 has swung about the cam hinge 74 in response to movement of the roller 68, thus drawing the link 78 upwardly, which causes a corresponding rotation of the throttle signal output member 81. In this position, the clutch signal output member 108 is disengaged from the drive means and is held in the neutral position by interference between the concave end wall 160 which is adjacent the surface 168 of the cam member 26. Thus, the clutch signal output member is maintained in the neutral position during the rotation of the lever by a rotation limiter means associated therewith. The rotation limiter means is characterized by the interrupter driving means having a cylindrical surface, eg. the surface 168, which is responsive to lever rotation, and the clutch signal output member 108 having a cooperating surface, ie. the concave end wall 160, which interferes with the surface 168 to prevent rotation of the member 108.

OPERATION

Operation of the device will now be summarized briefly. Initially it is assumed that the lever is in the neutral position 58 as shown in FIG. 1, with the teeth 47 and 48 in engagement with the toothed portion 109 of the clutch signal output member 108. In this position, as seen in FIG. 3, the roller 68 is adjacent the inner portion of the cam track, the shoulder 37 is adjacent the journal 17 and the flange 171 is adjacent the toothed portion 109. Rotation of the lever per the arrow 143 to attain the forward gear engaged position 59 causes the gear teeth 47 and 48 to drive the clutch signal member 108 through the position shown in FIG. 4 until the concave surface 117 contacts the periphery 40 of the cam plate and the roller 68 is at the position 140. Further rotation of the lever 22 in direction of the arrow 143 produces no change in the clutch signal as the teeth 47 and 48 are disengaged from the toothed portion 109, but there is a change in throttle signal as the secondary portion 138 of the cam track passes the roller 68, thus increasing the thottle signal from idle to full ahead. The roller 53 of the indexing arm 50 engages the index 43 when the forward gear is fully engaged and further lever rotation is unimpeded by the roller 53 as it rolls on the cylindrical periphery 40.

Reversed rotation of the lever 22 reverses the above function, that is the throttle signal decreases from full throttle to idle when the roller 68 passes the position 140, at which time the teeth 47 and 48 re-engage the toothed portion 109, thus causing the clutch output signal to change from ahead to neutral position as the roller 68 attains the central position of the primary portion 131. Further rotation of the lever in the reversed direction rotates the clutch signal output member until the concave surface 116 engages the periphery 140, representing the engagement of the reverse gear, and further reversed rotation of the lever increases engine r.p.m. from idle to full speed astern.

For a throttle override situation, for example, when operating auxiliary equipment, the lever is again positioned in neutral as shown in FIG. 1 and is then moved axially relative to the body along the axis 24 in the direction of the arrow 152, FIG. 5, so that the projection 157 can pass through the clearance opening 165, thus simultaneously disengaging the teeth 47 and 48 from the toothed portion 109. This requires positive compression of the spring 31 and thus can rarely, if ever, occur accidentally. In this position, the roller 68 is withdrawn partially out of the cam track 28, as best seen in FIG. 5, but is still sufficiently in contact with the side walls to maintain cooperation between the cam track and the cam follower. Further axial movement of the lever shaft 21 per the arrow 152 when the lever is in neutral is prevented by interference between the flange 171 and the projection member 159, and when the lever is in non-neutral positions is prevented by interference between the projection 157 and the wall member 164. The clutch signal output means 108 is maintained in neutral by interference between the concave end wall 160 and the surface 168, 40, and the lever can be swung in either direction between idle and full throttle positions. This is because the end wall 160 can be positioned to be concentric with the axis 24 only when the clutch output signal is neutral. When the lever returns to neutral, the spring 31 automatically tends to force the projection back through the clearance opening 165 and thus de-activates the throttle override to engage automatically normal operation.

ALTERNATIVES AND EQUIVALENTS

It can be seen that other devices apart from a marine power unit can be controlled using this single lever control with disengagement capabilities as described. In this particular instance, the throttle can be considered to be controlled by a first signal output means and the clutch/gearbox assembly can be controlled by a second signal output means. It is noted that the first and second signal output means include rocker arms which are journalled relative to the body about the common signal output axis 84. While this is not essential, it simplifies construction and fitting. Also, in other applications it may be desirable to have a different relationship between rotation of the lever and the first and second signal outputs. For example, lever rotation from one extreme position could result in continuously varying first and second signals, which could be disengaged at a particular position by axial movement of the lever to provide one varying signal output responsive to lever rotation and a nonvarying signal output disengaged from the lever.

Also, for twin engine control which is not shown, two separate levers controlling separate respective cam plates and interrupter driving means can be stacked together with aligned lever axes. To ensure equal throttle output signals, the cam hinges would be positioned on opposite sides of the lever axes. For example, when referring to FIG. 1, a second cam hinge axis 74.1 would be used for the second cam plate on an opposite side of the body 12 from the lever axis 24. The two cam followers would then be in equal positions on the cam track for the same rotation of the lever, thus ensuring equal throttle output signals.

It can be seen that the cam plate 26 has a portion of the periphery 40 which serves an interrupter driving means which has a driving engagement means, namely the gear teeth 47 and 48, and non-driving surface means, namely the partially cylindrical surface of the periphery 40 adjacent the teeth so as to provide the two different types of cooperation with the second signal output means, namely the clutch signal output member 108. The member 108 has an interrupter driven means which has driven engagement means, namely the toothed portion 109 which is engageable with the driving engagement means when the lever is in the engaged position so that the driving means is responsive to the primary rotation. The interrupter driven means also has a non-driven surface means, namely the two concave surfaces 116 and 117 adjacent the driven engagement means so that when the lever is in the engaged position, during secondary rotation of the lever, the non-driving and non-driven surface means interfere with each other so that the interrupter driven means and the second signal output means are non-responsive to the secondary rotation of the interrupter driving means. In this embodiment, it can be seen that the interrupter driving means is characterized by a plurality of gear teeth and the non-driving surface means is a generally cylindrical surface concentric with the lever axis. It can also be seen that the interrupter driven means is characterized by a plurality of gear teeth complementary to the gear teeth of the interrupter driving means, and that the non-driven surface means is a generally cylindrical surface complementary to the non-driving surface means. Mechanical equivalents to effect similar responses are available, namely various types of intermittent drive mechanisms such as drives used in watch stops using pin gear and complementary slot drives. An important feature is that the interrupter driving and driven means can be engaged and disengaged by axial movement of the lever, so that when the drive means are disengaged, rotation of the lever effects only the first signal output means, and when engaged rotation of the lever produces a desired sequence of signal outputs from both the first and second signal output means. It can be understood that the profile of the cam track can be varied so as to produce a first signal output response different from that disclosed herein for applications other than that described.

I claim:

1. A control lever assembly having: a body; a lever mounted for rotation about a lever axis relative to the body, and for axial movement along the lever axis relative to the body between engaged and disengaged positions; and first and second signal output means mounted for rotation relative to the body, the assembly being characterized by:

(a) interrupter driving means cooperating with the first signal output means and with the lever and being responsive to the rotation of the lever, (b) interrupter driven means cooperating with the second signal output means and being engageable with the interrupter driving means when the lever is in the engaged position so that the driven means is responsive to at least a portion of the rotation of the lever, (c) selector means to permit axial movement of the lever between the engaged and disengaged positions when the lever is in a particular position only, the selector means having a projection and a wall member, the projection being mounted for rotational movement with the interrupter driven means, the wall member being mounted for axial and rotational movement with the lever, the wall member having a clearance opening of a size adapted to pass the projection when aligned therewith during the axial movement of the lever in the particular position, and to interfere with the projection when non-aligned, so that the axial movement permits disengagement between the driven means and the driving means, and when so disengaged to permit rotation of the lever and the interrupter driving means with no corresponding movement of the second signal output means.

2. A control lever assembly as claimed in claim 25, in which the selector means is associated with the interrupter driven means and the lever, and is characterized by:

(a) a wall member having a clearance opening and mounted for movement with one interrupter means, (b) a projection mounted for movement with the remaining interrupter means and being of a size to permit passage relative to the clearance opening in the wall member when aligned with the clearance opening during axial movement of the lever in the particular position, and to interfere with the wall member when non-aligned with the clearance opening.

3. A control lever assembly as claimed in claim 2 in which:

(a) the wall member is mounted for rotation with the lever, (b) the projection is mounted for movement with the interrupter driven means.

4. A control lever assembly as claimed in claim 1 further including a rotation limiter means in which:

(a) a partially cylindrical surface concentric with the lever axis is provided adjacent the wall member, and an extension portion of the wall member is spaced from an opposed face by a gap approximately equal to width of the partially cylindrical surface, (b) the projection has a concave outer end wall which can be positioned to be concentric with the lever axis and generally complementary to and spaced closely from the partially cylindrical surface, the projection being thinner than the gap between the extension portion of the wall member and the opposed face to permit rotational relative movement between the projection and the wall member when the lever is rotated whilst in the disengaged position, and adapted so that interference between the concave end wall of the projection and the partially cylindrical surface essentially prevents movement of the second signal output member.

5. A control lever assembly as claimed in claim 4 in which:

(a) sum of thicknesses of the extension portion of the wall member and the projection is less than the axial movement of the lever between the engaged and disengaged positions.

6. A control lever assembly as claimed in claim 1 further including a rotation limiter means characterized by:

(a) the interrupter driving means having a partially cylindrical surface responsive to lever rotation, (b) the interrupter driven means has a cooperating surface which interferes with the partially cylindrical surface to prevent rotation of the interrupter driven means.

7. A control lever assembly as claimed in claim 1 in which the lever is mounted for primary and secondary rotation, and in which:

(a) the interrupter driving means is responsive to the primary and secondary rotation of the lever and has a driving engagement means and non-driving surface means adjacent the driving engagement means, (b) the interrupter driven means has a driven engagement means which is responsive to the primary rotation of the lever in the engaged position, and also has a non-driven surface means adjacent the driven engagement means, so that when the lever is in the engaged position, during secondary rotation of the lever the non-driving and non-driven surface means interfere with each other so that the interrupter driven means and the second signal output means are non-responsive to the secondary rotation of the interrupter driving means, (c) when the driving means are disengaged, the lever can be rotated through both primary and secondary rotations with no corresponding movement of the second signal output means.

8. A control lever assembly as claimed in claim 7 in which:

(a) the interrupter driving means is characterized by a plurality of gear teeth and the non-driving surface means is a generally cylindrical surface concentric with the lever axis, (b) the interrupter driven means is characterized by a plurality of gear teeth complementary to the gear teeth of the interrupter driving means, and the non-driven surface means is a partially cylindrical surface complementary to the non-driving surface means.

9. A control lever assembly as claimed in claim 8 in which:

(a) the axial movement of the lever means between the engaged and disengaged positions is greater than axial width of the teeth of the interrupter driven means so as to permit complete disengagement of the teeth.

10. A control lever assembly as claimed in claim 8 further including:

(a) the interrupter driving means having a flange extending adjacent the gear teeth thereof, the flange being adapted to contact gear teeth of the interrupter driven means to limit axial movement of the lever in one direction.

11. A control lever assembly as claimed in claim 1 in which cooperation between the first signal output means and the interrupter driving means is characterized by:

(a) the interrupter driving means having a cam means, (b) the first signal output means having a cam follower mounted on a cam arm and cooperating with the cam means, the cam arm cooperating with the first signal output means to reflect cam follower movement.

12. A control lever assembly as claimed in claim 11 in which:

(a) the cam arm is hinged for rotation relative to the body, (b) a link extends between the cam arm and the first signal output means to transfer cam arm rotation to the first signal output means.

13. A control lever assembly as claimed in claim 11 in which:

(a) the cam means has a cam track defined in part by spaced cam side walls, the side walls having a width which defines depth of the cam track which is greater than axial movement of the driving means between engaged and disengaged positions, (b) the cam follower has a width sufficient to maintain contact with the cam track side walls during the axial movement of the driving means.

14. A control lever assembly as claimed in claim 13 in which:

(a) the cam track has a primary portion which is a curve which is concentric with the lever axis and represents primary rotation of the lever means, and a secondary portion which is a curve which is eccentric relative to the lever axis and represents secondary rotation of the lever means.

15. A control lever assembly as claimed in claim 1 in which:

(a) the first and second signal output means include arms which are journalled relative to the body about a common signal output axis.

16. A control lever assembly as claimed in claim 1 further including:

(a) indexing means mounted on the body for motion relative thereto to cooperate with the driving means, (b) the driving means has index locations thereon complementary to the index means to reflect particular locations of the lever when engaged by the indexing means.

17. A control lever assembly as claimed in claim 1 for controlling a marine propulsion system as a single lever control for controlling concurrently a throttle and a clutch/gearbox assembly of a marine power unit, the assembly being further characterized by:

(a) the first signal output means is adapted to control the throttle, (b) the second signal output means is adapted to control the clutch/gearbox assembly, (c) the primary rotation of the lever represents rotation of the lever between forward and reversed engaged positions during which the throttle signal remains at idle and forward or reverse is being engaged in the clutch/gearbox assembly, and the secondary rotation of the lever represents the throttle output to increase engine r.p.m. from idle to full speed, whilst the clutch is maintained engaged.

18. A control lever assembly having: a body; a lever mounted for primary and secondary rotation about a lever axis relative to the body, and for axial movement along the lever axis relative to the body between engaged and disengaged positions; and first and second signal output means mounted for rotation relative to the body, the assembly being characterized by:

(a) interrupter driving means cooperating with the first signal output means and with the lever and being responsive to the primary and secondary rotation of the lever, the driving means having a driving engagement means and non-driving surface means adjacent the driving engagement means, (b) interrupter driven means cooperating with the second signal output means and being engageable with the interrupter driving means when the lever is in the engaged position so that the driven means is responsive to at least a portion of the rotation of the lever, the interrupter driven means has a driven engagement means which is responsive to the primary rotation of the lever in the engaged position, and also has a non-driven surface means adjacent the driven engagement means, so that when the lever is in the engaged position, during secondary rotation of the lever the non-driving and non-driven surface means interfere with each other so that the interrupter driven means and the second signal output means are non-responsive to the secondary rotation of the interrupter driving means, (c) selector means to permit axial movement of the lever between the engaged and disengaged positions when the lever is in a particular position only, so as to disengage by the axial movement the interrupter driving means from the interrupter driven means, and when so disengaged to permit rotation of the lever and the interrupter driving means through both primary and secondary rotations with no corresponding movement of the second signal output means.

19. A control lever assembly as claimed in claim 18 in which:

(a) the interrupter driving means is characterized by a plurality of gear teeth and the non-driving surface means is a generally cylindrical surface concentric with the lever axis, (b) the interrupter driven means is characterized by a plurality of gear teeth complementary to the gear teeth of the interrupter driving means, and the non-driven surface means is a partially cylindrical surface complementary to the non-driving surface means.

20. A control lever assembly as claimed in claim 19 in which:

(a) the axial movement of the lever means between the engaged and disengaged positions is greater than axial width of the teeth of the interrupter driven means so as to permit complete disengagement of the teeth.

21. A control lever assembly as claimed in claim 19 further including:

(a) the interrupter driving means having a flange extending adjacent the ear teeth thereof, the flange being adapted to contact gear teeth of the interrupter driven means to limit axial movement of the lever in one direction.

22. A control lever assembly as claimed in claim 18 in which cooperation between the first signal output means and the interrupter driving means is characterized by:

(a) the interrupter driving means having a cam means, (b) the first signal output means having a cam follower mounted on a cam arm and cooperating with the cam means, the cam arm cooperating with the first signal output means to reflect cam follower movement.

23. A control lever assembly as claimed in claim 22 in which:

(a) the cam arm is hinged for rotation relative to the body, (b) a link extends between the cam arm and the first signal output means to transfer cam arm rotation to the first signal output means.

24. A control lever assembly as claimed in claim 22 in which:

(a) the cam means has a cam track defined in part by spaced cam side wall, the side walls having a width which defines depth of the cam track which is greater than axial movement of the driving means between engaged and disengaged positions, (b) the cam follower has a width sufficient to maintain contact with the cam track side walls during the axial movement of the driving means.

25. A control lever assembly having: a body; a lever mounted for rotation about a lever axis relative to the body, and for axial movement along the lever axis relative to the body between engaged and disengaged positions; and first and second signal output means mounted for rotation relative to the body, the assembly being characterized by:

(a) interrupter driving means having a partially cylindrical surface and cooperating with the first signal output means and with the lever, the driving means and the surface being responsive to the rotation of the lever, (b) interrupter driven means cooperating with the second signal output means and being engageable with the interrupter driving means when the lever is in the engaged position so that the driven means is responsive to at least a portion of the rotation of the lever, the driven means also having a cooperating surface which interfers with the partially cylindrical surface to prevent rotation of the driven means, (c) selector means to permit axial movement of the lever between the engaged and disengaged positions when the lever is in a particular position only, so as to disengage by the axial movement the interrupter driving means from the interrupter driven means, and when so disengaged to permit rotation of the lever and the interrupter driving means with no corresponding movement of the second signal output means.

* * * * *